US008443889B2

(12) United States Patent
Xu et al.

(10) Patent No.: US 8,443,889 B2
(45) Date of Patent: May 21, 2013

(54) TELESCOPING CONDUITS WITH SHAPE MEMORY FOAM AS A PLUG AND SAND CONTROL FEATURE

(75) Inventors: Richard Yingqing Xu, Tomball, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 259 days.

(21) Appl. No.: 12/821,416

(22) Filed: Jun. 23, 2010

(65) Prior Publication Data

US 2011/0315226 A1 Dec. 29, 2011

(51) Int. Cl.
*E21B 49/10* (2006.01)

(52) U.S. Cl.
USPC ..... 166/305.1; 166/100

(58) Field of Classification Search
USPC ..... 166/278, 51, 305.1, 376, 369, 100
See application file for complete search history.

(56) References Cited

U.S. PATENT DOCUMENTS

| | | | | |
|---|---|---|---|---|
| 5,829,520 | A | 11/1998 | Johnson | |
| 6,752,208 | B1 * | 6/2004 | Nguyen | 166/280.1 |
| 7,013,979 | B2 | 3/2006 | Richard | |
| 7,316,274 | B2 | 1/2008 | Xu et al. | |
| 7,318,481 | B2 | 1/2008 | Richard | |
| 7,395,856 | B2 | 7/2008 | Murray | |
| 7,401,648 | B2 * | 7/2008 | Richard | 166/278 |
| 7,475,729 | B2 | 1/2009 | Johnson | |
| 7,552,779 | B2 | 6/2009 | Murray | |
| 7,591,312 | B2 | 9/2009 | Johnson et al. | |
| 7,604,055 | B2 | 10/2009 | Richard et al. | |
| 2008/0264647 | A1 * | 10/2008 | Li | 166/373 |
| 2008/0296024 | A1 | 12/2008 | Huang et al. | |
| 2009/0151957 | A1 * | 6/2009 | Sickle et al. | 166/373 |
| 2009/0173497 | A1 | 7/2009 | Dusterhoft | |
| 2010/0089565 | A1 | 4/2010 | Duan et al. | |
| 2010/0236794 | A1 * | 9/2010 | Duan et al. | 166/387 |

* cited by examiner

*Primary Examiner* — Nicole Coy
(74) *Attorney, Agent, or Firm* — Steve Rosenblatt

(57) ABSTRACT

A string with a plurality of telescoping members has the telescoping members initially sealed preferably with a shape memory foam so that the foam is initially impervious when run into a subterranean location. Then, after extension of the telescoping members, using pressure in the string, the foam gets above its transition temperature and grows axially in a passage of the telescoping members, to the point of becoming porous so that it can serve as a sand control or other debris exclusion device. Plates with openings can be deployed at opposed ends to maintain the assembly in position when subjected to differential pressure as flow goes through the foam. Alternative materials are envisioned.

22 Claims, 2 Drawing Sheets

TELESCOPING CONDUITS WITH SHAPE MEMORY FOAM AS A PLUG AND SAND CONTROL FEATURE

FIELD OF THE INVENTION

The field of this invention is the use of telescoping passages that can be moved out in an open hole completion and that have a sand control feature.

BACKGROUND OF THE INVENTION

Telescoping passages in a string have been used for production or injection. The passages in the telescoping members are initially closed so that internal pressure in the string can be developed to power out the telescoping members against the formation. In some application, the extended members against the formation provide the conduit for flow after a cement job fills the annular space around the extended members. In open hole completions the passages in the telescoping members can also have a sand control feature such as a bead pack that traps solids as the passages are put in service in a production mode.

In order to extend the telescoping members the blocking agent used was biodegradable polyvinyl alcohol that was applied to a bead pack. The material provided a seal long enough to be able to move the telescoping members out to the formation. Eventually the material disappeared such as by melting or dissolving and the passage was then opened with the telescoping assemblies extended so that the bead pack in the passage was now exposed and ready to function as a sand control device. In order to allow enough time to deploy the string and extend the telescoping members the disappearing time would be set to take days. In some instances particular fluids had to be introduced to initiate the disappearing of the plug.

Disappearing plugs have been used in zone isolation as illustrated in U.S. Pat. Nos. 7,395,856 and 7,552,779. Telescoping members with a sand control feature are illustrated in U.S. Pat. Nos. 7,475,729 and 7,604,055. The following patents show a telescoping assembly with a barrier used to extend the members and how the barrier is then removed: U.S. Pat. Nos. 5,829,520; 7,316,274 and 7,591,312. Swelling materials such as shape memory foam are illustrated to function as an annularly shaped screen in a downhole application in U.S. Pat. Nos. 7,318,481 and 7,013,979.

The present invention replaces the blocking material that allows pressure to extend the telescoping elements with a shape memory foam that is compressed at above its critical temperature to an extent that it is effectively impervious. It is mounted in the passage of the telescoping assemblies and allows them to be extended under pressure in the string. After extension and exposure to well fluids the critical temperature is crossed and the foam reverts to its original shape before its temperature was initially elevated. In that reverting condition the foam becomes porous and serves as a sand control barrier. The foam is constrained to enlarge in an axial direction by the telescoping assembly. Porous end supports can be optionally used to hold the foam in position against the force of flow going through the foam. In essence the foam in one state acts as a plug for extension of the telescoping member and in the second state serves as a sand or other debris excluder from production. Those and other aspects of the present invention can be better understood by those skilled in the art from a review of the description of the preferred embodiment and the associated drawings while understanding that the full scope of the invention is to be determined by the appended claims.

SUMMARY OF THE INVENTION

A string with a plurality of telescoping members has the telescoping members initially sealed preferably with a shape memory foam so that the foam is initially impervious when run into a subterranean location. Then, after extension of the telescoping members, using pressure in the string, the foam gets above its transition temperature and grows axially in a passage of the telescoping members, to the point of becoming porous so that it can serve as a sand control or other debris exclusion device. Plates with openings can be deployed at opposed ends to maintain the assembly in position when subjected to differential pressure as flow goes through the foam. Alternative materials are envisioned.

DETAILED DESCRIPTION OF THE PREFERRED EMBODIMENT

Figure 1:
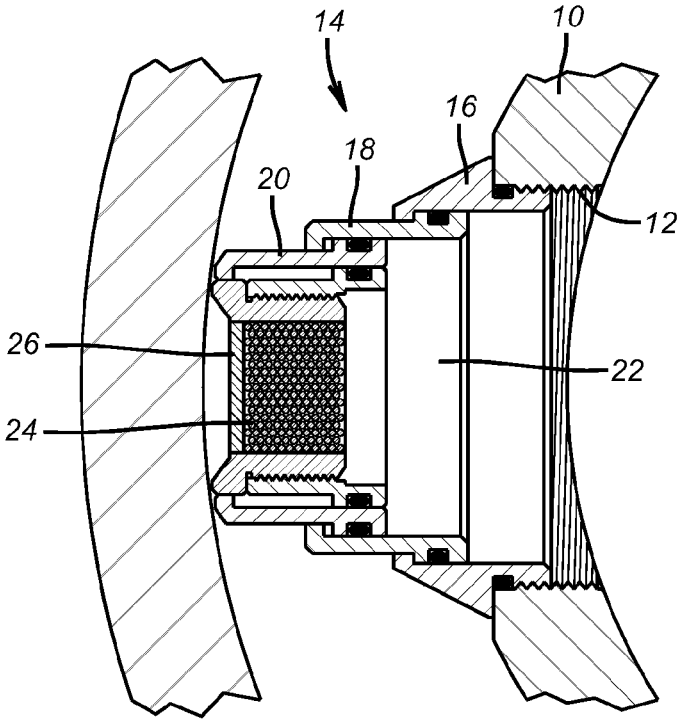
(PRIOR ART) FIG. 1
FIG. 1 shows a section view through a telescoping member with a bead pack in the passage as is known in the prior art.
Figure 2:
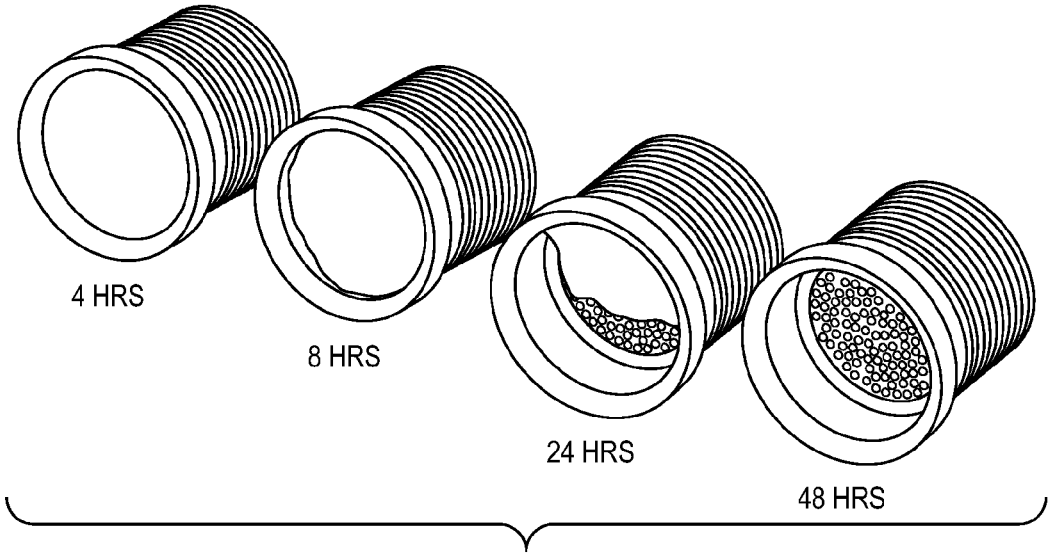
(PRIOR ART) FIG. 2
FIG. 2 shows a time lapse of a removable barrier of polyvinyl alcohol disappearing over time and exposing the bead pack as is known in the prior art.

FIG. 1 illustrates a section through a tubular 10 where an opening 12 that is representative of a plurality of similar assemblies has a multi-component telescoping assembly 14 that is made up of subparts 16, 18 and 20. The subparts define a passage 22 in which sits a bead pack 24 and a removable blocking material 26 such as polyvinyl alcohol. FIG. 2 illustrates what happens to the blocking material over time after the pressure in tubular 10 extends the telescoping assembly 14. The different views of the same layer of blocking material 26 show it gradually disappearing due to thermal exposure over a 48 hour period. The removal of the blocking material 26 exposes the bead pack 24 at a time when the telescoping assembly 14 has already been extended. The bead pack is now able to serve as a sand control device using the small spaces among the beads. In essence the blocking material 26 has to stay cohesive long enough to withstand a pressure differential large enough to fully telescope the assembly 14 against the wellbore wall which can be open hole with the formation exposed or a cased hole so that the assembly engages the surrounding tubular. After extension, the blocking material 26 needs to disappear so as not to impede production flow.

Figure 3:
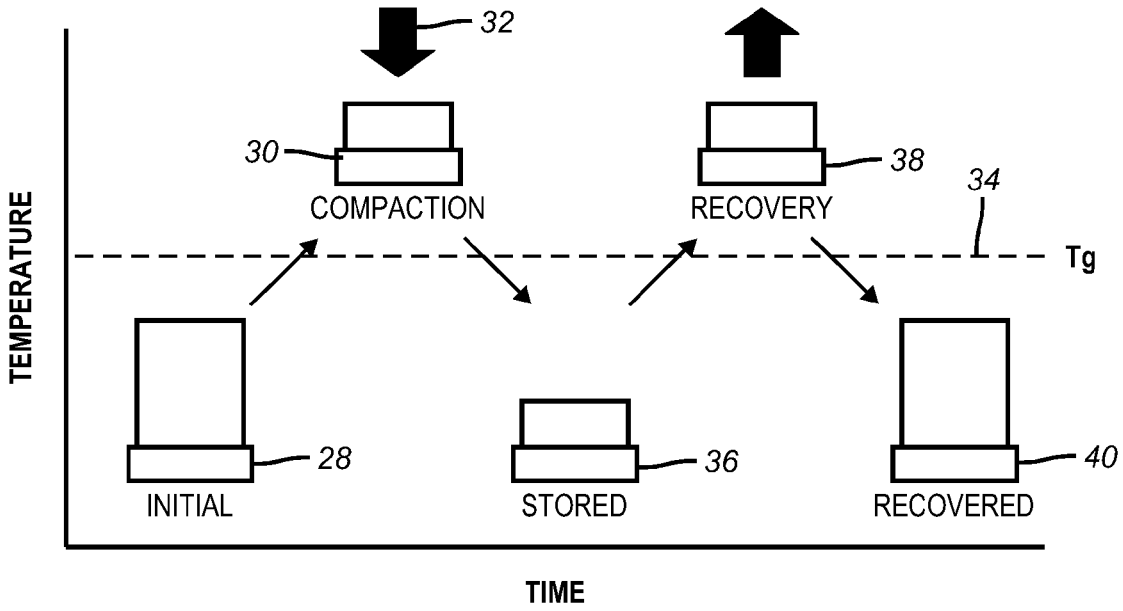
FIG. 3 is a schematic illustration of the preparation and use of shape memory foam into an initial compressed state where it is a pressure barrier and into an expanded state where it is a porous member acting as a sand control device.
Figure 4:
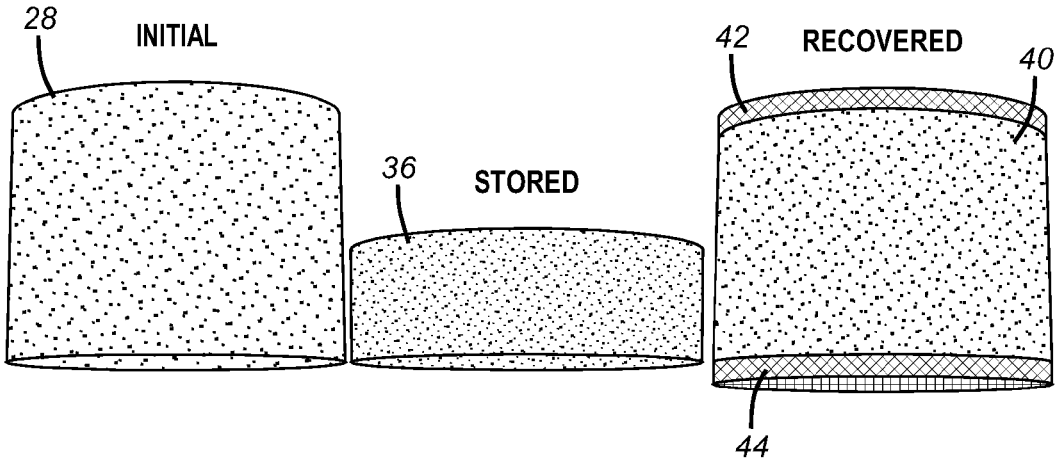
FIG. 4 shows the foam in its initial state followed by its compressed state and then after it has reverted back to its initial state for sand control service.

The present invention is shown in FIGS. 3 and 4. FIG. 3 shows taking a shape memory foam 28 where it is porous and compressing it at a temperature above its critical temperature to a compressed shape 30 where it is less porous or impervious and while it is still in compression as represented by arrow 32 letting it cool below the critical temperature represented by dashed line 34 so that when the compressive force is removed at a temperature below the critical temperature the compressed shape indicated at 36 is retained. In the condition of 36 the shape is put into the passage such as 22 in FIG. 1 instead of the bead pack 24. Note that the blocking material 26 used in the past is no longer needed as shape 36 can resist applied pressure sufficiently to allow the telescoping assembly 14 to push out.

After extension of the assembly 14 and exposure to well fluid temperatures for a predetermined time or the application of heat from an independent source such as a heater, the critical temperature 34 is crossed again as represented by 38. The shape 38 being in the passage 22 is restrained from growing diametrically and is able to extend axially in the passage 22 to reach the state 40 which is close to or at the condition at 28. In this condition the shape is porous and can serve as a sand control device. Rigid porous barriers 42 or/and 44 can be affixed to the assembly 14 so that when there is flow through the shape 40 that is stays in position.

While a shape memory foam is preferred other materials that can retain a pressure differential in one state and are porous in another are within the scope of the invention. For example a sponge can be held in passage 22 in a mechanically compressed state so that pressure against it will push out the assemblies 14 and then the mechanical compressive force can be released in a variety of ways so that the sponge is allowed to expand and become porous where it can serve as a sand control device. The compressive force can be held by a latch that is released chemically or thermally or with pressure, to give a few examples. The invention encompasses a material that has two conditions that enables pressure extension of telescoping members and subsequent sand control from the same material when the telescoping assemblies are extended.

While a production application is described an injection service is also contemplated. In that case the material 40 controls impurities in the steam from entering the injection well or solids in the well from entering the tubular 10 when no injection is taking place.

The above description is illustrative of the preferred embodiment and many modifications may be made by those skilled in the art without departing from the invention whose scope is to be determined from the literal and equivalent scope of the claims below.

We claim:

1. An assembly for communicating between a subterranean location and a tubular string having at least one opening, comprising:

a telescoping assembly having a passage therethrough defined by a surrounding wall of a predetermined sham;

a foam material in position in said passage and in contact with said wall as said tubular string is run in toward the subterranean location, said foam resists pressure differential in a first state to a degree sufficient to extend said telescoping assembly with pressure in the tubular string and a second state where said material is porous and continues to be contained by said surrounding wall to allow fluid flow while retaining solids when said telescoping assembly is extended.

2. The assembly of claim 1, wherein:

said material changes between said first and second states with a thermal stimulus.

3. The assembly of claim 2, wherein:

said material comprises a shape memory foam.

4. The assembly of claim 3, wherein:

said material is porous in an initial state before being placed in said first state by a combination of heat and compression.

5. The assembly of claim 4, wherein:

said material is in said first state when assembled into said passage.

6. The assembly of claim 5, wherein:

said material grows axially in said passage between said first and second states.

7. The assembly of claim 6, wherein:

said passage comprises at least one travel stop for retaining said material in said passage against flow or differential pressure.

8. The assembly of claim 1, wherein:

said material changes between said first and second states with a release of applied compressive force.

9. The assembly of claim 8, wherein:

said material comprises a sponge.

10. The assembly of claim 1, wherein:

said material is porous in an initial state before being placed in said first state by a combination of heat and compression.

11. The assembly of claim 10, wherein:

said material is in said first state when assembled into said passage.

12. The assembly of claim 1, wherein:

said passage comprises at least one travel stop for retaining said material in said passage against flow or differential pressure.

13. The assembly of claim 1, wherein:

said material grows axially in said passage between said first and second states.

14. A method of communicating a subterranean location and a tubing string through at least one opening in the string further comprising a telescoping assembly in said opening having a passage therethrough defined by a surrounding wall of a predetermined shape, comprising:

placing foam material in the passage in contact with said wall as said tubing string is run in toward the subterranean location in a first state where it resists applied pressure sufficiently to extend the telescoping assembly;

extending the telescoping assembly with said material in said first state;

changing the material to a second state where it is porous and continues to be contained by said surrounding wall;

retaining solids in said material when fluid flows through said material in said second state.

15. The method of claim 14, comprising:

using heat to change the state of said material to said second state.

16. The method of claim 14, comprising:

using a shape memory foam as said material.

17. The method of claim 14, comprising:

starting with said material in an initial state where it is porous;

changing said material to said first state with compression and heat to a predetermined temperature;

installing said material in said passage when in said first state.

18. The method of claim 17, comprising:

allowing said material to grow axially in said passage when going to said second state.

19. The method of claim 18, comprising:

using heat to change the material to said second state from said first state.

20. The method of claim 19, comprising:

placing at least one travel stop on at least one side of said material in said passage;

using a shape memory foam as said material.

21. The method of claim 14, comprising:

using removal of a compressive force to change the state of said material to said second state.

22. The method of claim 21, comprising:

using a sponge as said material.

* * * * *